US008552349B1

(12) United States Patent
Alexander

(10) Patent No.: US 8,552,349 B1
(45) Date of Patent: Oct. 8, 2013

(54) PROJECTILE GUIDANCE KIT

(75) Inventor: Steven B. Alexander, Orange, CA (US)

(73) Assignee: Interstate Electronics Corporation, Anaheim, CA (US)

( * ) Notice: Subject to any disclaimer, the term of this patent is extended or adjusted under 35 U.S.C. 154(b) by 296 days.

(21) Appl. No.: 12/928,942

(22) Filed: Dec. 22, 2010

(51) Int. Cl.
*F42B 15/01* (2006.01)
*F41G 7/00* (2006.01)
*F42B 15/00* (2006.01)

(52) U.S. Cl.
USPC ..... 244/3.15; 244/3.1; 244/3.21; 244/3.24; 102/200; 102/206; 102/207; 701/400; 701/408; 701/468; 701/469; 701/470

(58) Field of Classification Search
USPC ..... 244/3.1–3.3; 102/473, 501, 200, 102/206, 211, 214, 221, 222, 223, 225, 226, 102/231, 232, 235, 237, 238, 239, 240, 244, 102/265, 266, 267, 475, 476, 489, 207, 208–210; 89/1.11; 343/700 R, 705, 708; 342/61, 342/62, 68; 701/1, 3, 400, 408, 468–470
See application file for complete search history.

(56) References Cited

U.S. PATENT DOCUMENTS

| | | | | | |
|---|---|---|---|---|---|
| 1,861,521 | A | * | 6/1932 | Brandt | 102/232 |
| 1,890,176 | A | * | 12/1932 | Brandt | 102/238 |
| 2,981,188 | A | * | 4/1961 | Lipinski et al. | 102/476 |
| 3,111,088 | A | * | 11/1963 | Fisk | 244/3.23 |
| 3,128,467 | A | * | 4/1964 | Lanctot | 343/708 |
| 3,366,059 | A | * | 1/1968 | Myers et al. | 102/235 |
| 3,450,048 | A | * | 6/1969 | Guerne | 102/240 |
| 3,583,319 | A | * | 6/1971 | James | 102/238 |
| 3,613,595 | A | * | 10/1971 | Blomgren et al. | 102/226 |
| 3,699,892 | A | * | 10/1972 | Kopec et al. | 102/214 |
| 3,750,575 | A | * | 8/1973 | Heede et al. | 102/489 |
| 3,994,230 | A | * | 11/1976 | Kalin | 102/267 |
| 4,142,696 | A | * | 3/1979 | Nottingham | 244/3.16 |
| 4,438,893 | A | * | 3/1984 | Sands et al. | 244/3.21 |
| 4,512,537 | A | * | 4/1985 | Sebestyen et al. | 244/3.21 |
| 4,592,525 | A | * | 6/1986 | Madderra et al. | 244/3.28 |
| 4,964,593 | A | * | 10/1990 | Kranz | 244/3.24 |

(Continued)

FOREIGN PATENT DOCUMENTS

WO WO2008/010226 1/2008

OTHER PUBLICATIONS

Gogue, et al; Voice-Coil Actuators, retrieved from the Internet <URL: http:/www.consult-g2.com/papers/paper8/paper.html>; retrieved on Oct. 5, 2010.

(Continued)

*Primary Examiner* — Bernarr Gregory
(74) *Attorney, Agent, or Firm* — Knobbe Martens Olson & Bear LLP

(57) ABSTRACT

Apparatus and methods provide a guidance kit that can be attached to a projectile, such as screwed into a fuze well of an artillery round or a mortar round. A portion of the guidance kit is configured to spin constantly during flight. In the context of an artillery round that is shot from a rifled barrel, the direction of the spin torque is counter to the direction of the spin induced by the rifled barrel. Control surfaces are present in the portion of the guidance kit that spins constantly during flight. While the portion spins, the control surfaces are actuated to steer the projectile towards an intended target via, for example, GPS.

16 Claims, 4 Drawing Sheets

(56) References Cited

U.S. PATENT DOCUMENTS

| | | | | |
|---|---|---|---|---|
| 5,139,216 | A * | 8/1992 | Larkin | 244/3.21 |
| 5,164,538 | A * | 11/1992 | McClain, III | 244/3.23 |
| 5,207,397 | A * | 5/1993 | Ng et al. | 244/3.29 |
| 5,372,333 | A * | 12/1994 | Uwira et al. | 244/3.16 |
| 5,379,968 | A * | 1/1995 | Grosso | 244/3.21 |
| 5,393,011 | A * | 2/1995 | Dunn et al. | 244/3.21 |
| 5,393,012 | A * | 2/1995 | Dunn | 244/3.23 |
| 5,417,393 | A * | 5/1995 | Klestadt | 244/3.27 |
| 5,423,497 | A * | 6/1995 | Ransom | 244/3.22 |
| 5,452,864 | A * | 9/1995 | Alford et al. | 244/3.23 |
| 6,364,248 | B1 * | 4/2002 | Spate et al. | 244/3.23 |
| 6,378,801 | B1 * | 4/2002 | Pell et al. | 244/3.24 |
| 6,796,525 | B2 * | 9/2004 | Johnsson et al. | 244/3.28 |
| 6,848,648 | B2 * | 2/2005 | Klestadt et al. | 244/3.23 |
| 6,981,672 | B2 * | 1/2006 | Clancy et al. | 244/3.24 |
| 7,150,428 | B2 * | 12/2006 | Dubois et al. | 244/3.13 |
| 7,354,017 | B2 | 4/2008 | Morris et al. | |
| 7,412,930 | B2 * | 8/2008 | Smith et al. | 244/3.23 |
| 7,431,237 | B1 * | 10/2008 | Mock et al. | 244/3.24 |
| 7,533,849 | B2 | 5/2009 | Zemany et al. | |
| 7,696,459 | B2 * | 4/2010 | Harnoy | 244/3.1 |
| 7,718,937 | B1 * | 5/2010 | Dunn et al. | 244/3.23 |
| 7,791,007 | B2 * | 9/2010 | Harnoy | 244/3.21 |
| 7,963,442 | B2 * | 6/2011 | Jenkins et al. | 244/3.1 |
| 8,076,623 | B2 * | 12/2011 | Dryer | 244/3.23 |
| 8,113,118 | B2 * | 2/2012 | Schmidt et al. | 102/244 |
| 8,319,163 | B2 * | 11/2012 | Flood et al. | 244/3.24 |
| 8,319,164 | B2 * | 11/2012 | Martinez | 244/3.27 |
| 2008/0061188 | A1 | 3/2008 | Morris et al. | |
| 2009/0084888 | A1 | 4/2009 | Shai | |

OTHER PUBLICATIONS

Tom Bybee; Precision Guidance Kit; 45th Annual NDIA Gun and Missile Systems Conference; May 18, 2010.

* cited by examiner

PROJECTILE GUIDANCE KIT

BACKGROUND

1. Field of the Invention

The invention generally relates to the satellite positioning system based guidance of munitions, and in particular, to guidance for an artillery round such that the artillery round is a precision weapon.

2. Description of the Related Art

The military use of artillery is well known. One drawback of conventional artillery, such as rockets, mortar rounds, artillery shells, and the like, is that without a guidance system, such artillery rounds can have a relatively large Circular Error Probable. The Circular Error Probable can grow large especially when distance is great and/or wind conditions are unstable. Without guidance, a relatively large number of munitions may be needed to ensure the destruction of a target. This can be costly both in terms of munitions and in physical resources that, with precision guidance, could otherwise be allocated to additional targets. In addition, the amount of collateral damage can be higher than desired.

When precision guidance is employed, the Circular Error Probable can be dramatically reduced. This permits a cost savings in the number of rounds, reduces the warning from earlier-fired rounds, reduces collateral damage, increases the effectiveness of a combat unit, and can even decrease the amount of training needed or data used (such as wind condition data).

One precision GPS-guided munition is the M982 Excalibur, which is a 155 mm guided artillery shell. While effective, the M982 Excalibur is expensive.

The XM1156 Precision Guidance Kit is a kit that replaces the existing fuze of a standard projectile. Accordingly, the costs are expected to be much less.

One system for guiding a projectile is taught in U.S. Pat. No. 6,981,672 to Clancy, et al. ("Clancy"). With reference to FIG. 1 of Clancy, canards 12 and 14, are spin canards, which enable the nose assembly 10 to counter rotate with respect to the rest of the projectile. Canards 16 and 18 steer the round. When the nose assembly 10 is spinning, the steering from the canards 16 and 18 has no net effect on flight trajectory. When the nose assembly 10 is despun, the canards 16 and 18 provide steering based on the rotational orientation of the canards 16 and 18 in the despun state. Despinning is accomplished via a brake. The brake imparts a torque to the nose assembly 10 in the direction of the spinning projectile. By balancing the torque from the spin canards and the brake, the rotational orientation of the nose assembly 10 can be adjusted.

Another system for guiding a projectile is taught in U.S. Pat. No. 7,354,017 to Morris, et al. ("Morris"). With reference to FIG. 1 of Morris, counter rotation fins 42 spin the guidance package 41. When the guidance package 41 is despun, the control surfaces 15 steer the projectile according to the rotational orientation of the control surfaces 15 in the despun state.

SUMMARY

The invention includes a guidance kit that can be attached to a projectile, such as in place of a fuze assembly. For example, the kit can be screwed into a fuze well of an artillery round or a mortar round. A portion of the guidance kit is configured to spin constantly during flight. In the context of an artillery round that is shot from a rifled barrel, the direction of the spin torque of the kit is counter to the direction of the spin induced by the rifled barrel. The direction of the spin of the kit itself can be either the same direction as or counter to the spin direction of the artillery round. Control surfaces are present in the portion of the guidance kit that spins constantly during flight. While the portion spins, the control surfaces are actuated to steer the projectile towards an intended target via, for example, GPS.

One advantage of having one or more actuatable control surfaces is that a brake between a despun portion and the projectile is not needed. In addition, sensors that would otherwise be needed for monitoring the relative orientation of the portion to be despun and respun would not be needed and corresponding computations for converting angles determined via GPS and for a separate spinning object would not need to be performed. In addition, by avoiding braking for despinning, embodiments of the invention substantially avoid reducing the spin rate of the projectile. When a projectile is spin stabilized, too much of a reduction in the spin rate can result in unstable flight and a corresponding loss in accuracy. This can be an important consideration in systems with relatively low spin rate margin.

One embodiment includes an apparatus, wherein the apparatus includes: a threaded housing configured to fasten into a fuze well of a projectile for attachment; a nose assembly configured to mate with the threaded housing such that at least a first portion of the nose assembly is within an interior of the threaded housing and a second portion of the nose assembly is outside of the threaded housing, wherein the nose assembly is configured to revolve without despinning with respect to the threaded housing; one or more fixed spin fins coupled to the nose assembly, wherein the one or more fixed spin fins are configured to generate a torque during flight in angular direction opposite to an angular direction of a spin of the projectile; one or more antennas configured to receive Global Positioning System (GPS) satellite navigation signals, wherein the one or more antennas are attached to the nose assembly such that the one or more antennas revolve with the nose assembly and not with the projectile; a GPS receiver configured to determine spatial position and rotational position, wherein the GPS receiver is coupled to the one or more antennas; a voice coil actuator; movable fins coupled to the nose assembly, wherein the movable fins are configured to move based on actuation by the voice coil actuator for steering of the projectile; a guidance and control system configured to control the voice coil actuator based at least partly on a pre-programmed trajectory, spatial position, and rotational position; a fuze for triggering of the artillery round, wherein the fuze is disposed within the first portion of the nose assembly; an alternator configured generate electrical power during flight of the artillery round and is not configured to controllably brake the nose assembly relative to the threaded housing, wherein at least a portion of the alternator is disposed in the threaded housing and another portion is disposed in the nose assembly; and at least one of a battery or a capacitor configured to provide power prior to operation of the alternator.

One embodiment includes an apparatus, wherein the apparatus includes: a housing configured to mount in a fuze well of a projectile for attachment; a nose assembly configured to mate with the housing such that at least a first portion of the nose assembly is within an interior of the housing and a second portion of the nose assembly is outside of the housing; one or more spin fins coupled to the nose assembly, wherein the one or more spin fins are configured to generate a torque during flight in an opposing direction to a direction of spin, if any, of the projectile, wherein the nose assembly is configured to revolve even during flight control; an actuator; one or more control surfaces coupled to the nose assembly, wherein the one or more control surfaces are configured to steer the projectile based on actuation by the actuator; and a guidance and control system configured to control the voice coil actuator based at least partly on a pre-programmed trajectory, spatial position, and rotational position.

One embodiment includes a method of controlling flight of a projectile, wherein the method includes: spinning a nose assembly via torque generated by one or more spin fins coupled to the nose assembly, wherein after launch and initial spin up, the nose assembly is spun continuously during flight, wherein the nose assembly comprises the one or more spin fins, a satellite positioning system receiver, one or more antennas for the satellite positioning system receiver, one or more control surfaces, and an actuator for the one or more control surfaces; actuating the one or more control surfaces to steer the projectile, wherein actuating is performed while the nose assembly is revolving without despinning the nose assembly to control the flight of the projectile; and steering the projectile along a pre-programmed trajectory.

One embodiment includes an apparatus for controlling flight of a projectile, wherein the apparatus includes: means for spinning a nose assembly via torque generated by one or more spin fins coupled to the nose assembly, wherein after launch and initial spin up, the nose assembly is spun continuously during flight, wherein the nose assembly comprises the one or more spin fins, a satellite positioning system receiver, one or more antennas for the satellite positioning system receiver, one or more control surfaces, and an actuator for the one or more control surfaces; means for actuating the one or more control surfaces to steer the projectile, wherein actuating is performed while the nose assembly is revolving without despinning the nose assembly to control the flight of the projectile; and means for steering the projectile along a pre-programmed trajectory.

BRIEF DESCRIPTION OF THE DRAWINGS

These drawings not to scale and the associated description herein are provided to illustrate specific embodiments of the invention and are not intended to be limiting.

DETAILED DESCRIPTION OF SPECIFIC EMBODIMENTS

Figure 1:
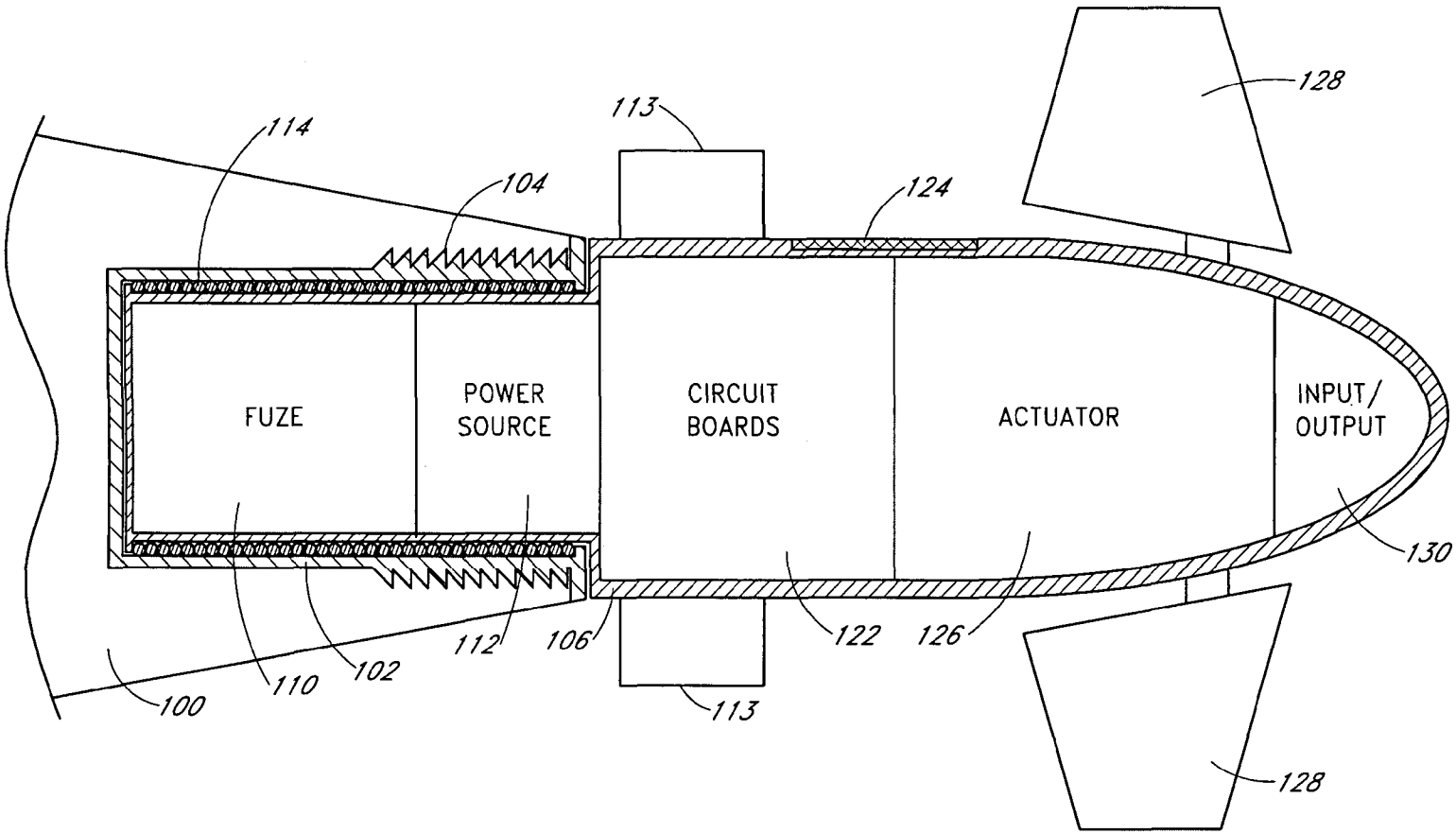
FIG. 1 illustrates a cross section of an embodiment of a projectile guidance kit.

Although particular embodiments are described herein, other embodiments of the invention, including embodiments that do not provide all of the benefits and features set forth herein, will be apparent to those of ordinary skill in the art. In this description, reference is made to the drawings in which like reference numerals indicate identical or functionally similar elements.

FIG. 1 illustrates a cross section of an embodiment of a projectile guidance kit. FIG. 1 is not to scale. A portion of a nose assembly for a projectile 100 is shown. The projectile 100 includes a fuze well into which a threaded housing 102 is screwed via threads 104 for attachment. Other attachment techniques can be used. For example, existing threads originally configured to engage with threads of a fuze assembly can be used.

A nose assembly 106 is coupled to the threaded housing 102 such that the nose assembly 106 can revolve with respect to the threaded housing 102. However, after fastening, the threaded housing 102 does not revolve or rotate with respect to the nose of the projectile 100. In the illustrated embodiment, a first portion of the nose assembly 106 is within an interior of the threaded housing 102 and a second portion of the nose assembly is outside of the threaded housing 102.

The first portion that is within the fuze well can house, for example, a fuze 110 and a power source 112. The fuze 110 functions to detonate explosives in the rest of the projectile 100. The fuze 110 should incorporate appropriate safety features for personnel, and can include, for example, one or more of a height of burst (HOB) trigger, impact trigger, delayed trigger, or the like. A power source 112 can also be included. The power source 112 can correspond to, for example, batteries, supercaps or electrochemical double layer capacitors, and generators/alternators. In one embodiment, the kit is powered by charge from batteries or supercaps until the generator/alternator is able to provide electrical power from flight. For example, in the context of an artillery shell for the projectile, the shell and the threaded housing 102 can be rotating in a particular angular direction because of the rifling of the barrel, and one or more fixed spin fins 113 coupled to the second portion of the nose assembly 106 can be configured to generate a torque during flight in an angular direction opposite to the angular direction of the projectile.

One or more bearings 114 can be used to permit the rotation of the nose assembly 106 with respect to the threaded housing 102. The bearings 114 can correspond to ball bearings, roller bearings, plain bearings, or the like. Thrust bearings (not shown) can also be utilized to handle the axial loads upon launch. While many bearings 114 are illustrated, one of ordinary skill in the art will appreciate that much fewer bearings 114 can be used.

A second portion of the nose assembly 106 can be outside of the threaded housing 102. In the illustrated example, the second portion houses circuit boards 122, one or more antennas 124, an actuator or servo 126, one or more movable fins or canards 128, an input/output section 130. Of course, additional components for other features such as height of burst (HOB) triggering of the fuze can also be included. As will be explained in greater detail later in connection with FIG. 3, in one embodiment, the actuator 126 corresponds to a voice coil actuator.

The circuit boards 122 can implement functions such as positioning via satellite positioning signals such as Global Positioning System (GPS) signals and other functions such as digital signal processing (DSP) for interference filtering, guidance and control functions, safe and arm functions for the fuze, height of burst triggering functions, power conditioning, generator or alternator control, or the like. In one embodiment, three PowerPC 440 processors are used. A first processor is utilized for satellite positioning system, such as GPS, signal acquisition, tracking, decoding of the navigation message, and the like. A second processor implements Kalman filtering and the determination of angular position. A third processor is utilized for guidance and control, and to execute instructions for guidance and flight control. General control functions are shared across the three processors. One embodiment of a technique that can be utilized to determine angular position is disclosed in U.S. patent application Ser. No. 12/231,315 filed Aug. 29, 2008, published as U.S. Patent Application Publication No. 2010-0052981 A1, the disclosure of which is hereby incorporated by reference herein.

The one or more antennas 124 receive satellite positioning system signals, such as GPS signals. In one embodiment, the one or more antennas correspond to two dual polarized antenna, which are spaced 180 degrees apart. One antenna, three antenna, and four antenna can also be used. In addition, other numbers of antenna will be readily determined by one of ordinary skill in the art.

The input/output section 130 can include a coil configured to interface for data exchange for initialization. For example, trajectory and targeting data can be downloaded, together with initialization data to speed up acquisition of GPS signals. Fuze settings can also be programmed. One embodiment is configured to interface with a standard Enhanced Portable Inductive Artillery Fuze Setter (EPIAFS), which can exchange data and provide external power.

Figure 2:
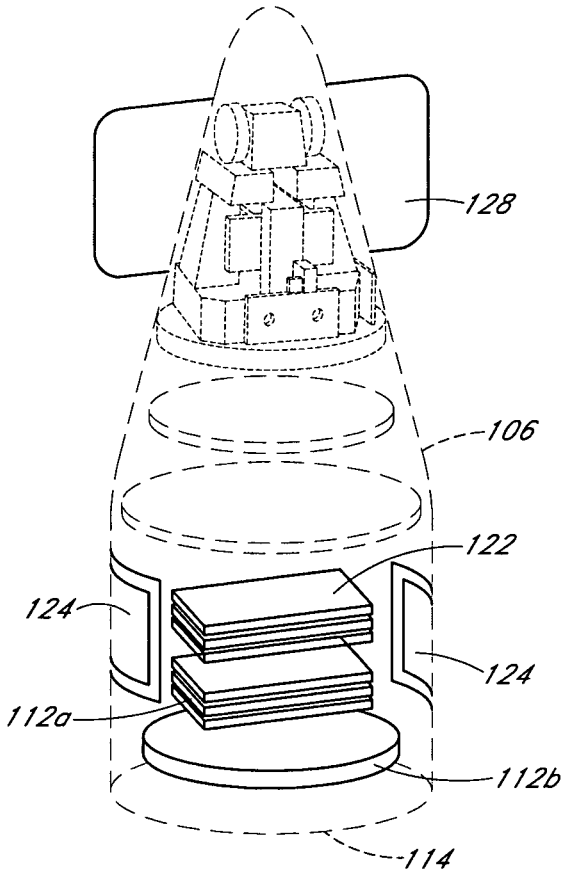
FIG. 2 illustrates a perspective view of an embodiment of a nose assembly of a projectile guidance kit.

FIG. 2 illustrates a perspective view of an embodiment of the nose assembly 106 of the projectile guidance kit. The spin fins 113 (FIG. 1) are not shown in FIG. 2. FIG. 2 illustrates the nose assembly 106, the movable fins 128, the circuit boards 122, the antennas 124, batteries and/or supercaps 112*a*, generator or alternator 112*b*, and bearings 114.

Figure 3:
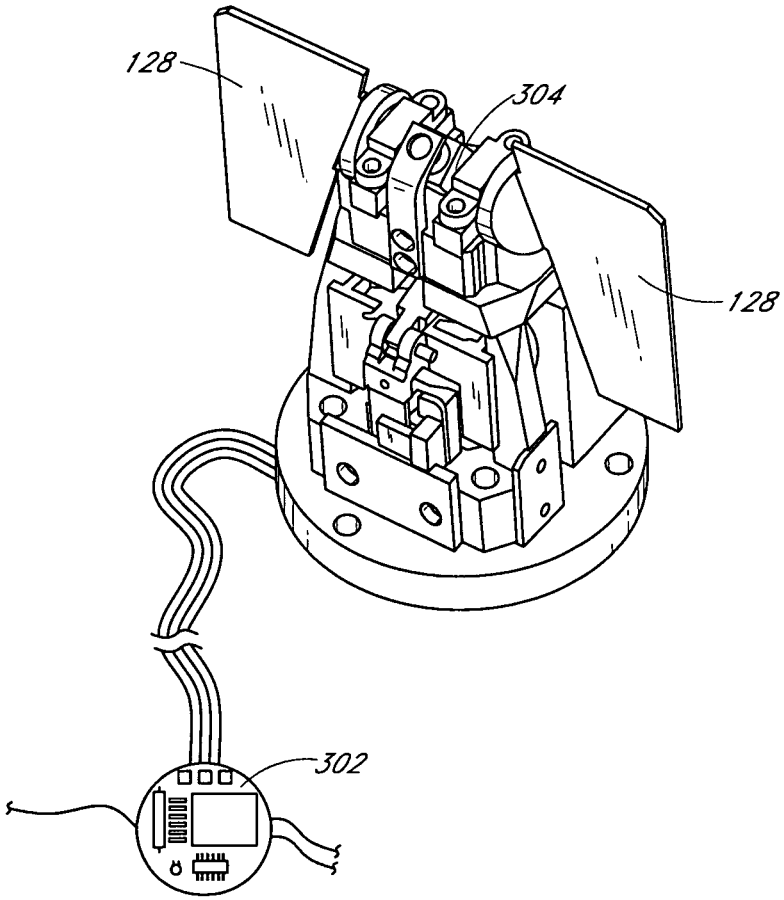
FIG. 3 illustrates an embodiment of a voice coil actuator.

FIG. 3 illustrates an embodiment of a voice coil actuator for the actuator 126 (FIG. 1). Voice-coil actuators are common in servos and can be found in a variety of devices, for example, hard disk drives, audio speaker motors, and the like. An example of a description of a voice-coil actuator can be found in, for example, <http://www.consult-g2.com/papers/paper8/paper.html>.

Advantageously, a voice-coil actuator is compact so that it can fit within the nose assembly 106 and is fast responding so that the movable fins 128 can be actuated even as the nose assembly 106 revolves at relatively high speed. Since the nose assembly 106 continuously revolves during flight, the movable fins 128 are actuated in a particular direction in phase with the spin for a particular angle of force, and with 180 degrees of revolution from that angle, the movable fins 128 are actuated in a direction opposite to the particular direction.

Among other features, a voice-coil actuator has one or more permanent magnets, a pole piece, a voice coil, and control electronics 302. Many of the internal components of the voice-coil actuator are hidden from view in FIG. 3. The voice-coil actuator can also include one or more position sensors. During operation, the current passing through the voice coil results in linear motion of the voice coil with respect to a pole piece. In one embodiment, control of the voice coil actuator is accomplished via pulse-width modulation (PWM). Using PWM, digital switches can control the current in a more efficient manner than would be the case with an analog amplifier.

In the illustrated embodiment, the linear motion of the voice coil is converted to a rotational or twisting motion, via a crank or a crankshaft 304. The crank and a shaft can be separate or combined in to the crankshaft 304. A connecting rod can be used to connect a bobbin of the voice coil to the crank or the crankshaft 304. The rotational motion of the crankshaft 304 results in deflection of the movable fins 128 for flight control.

As previously noted, the nose assembly 106 is configured to revolve continuously while in flight (after initial spin up), that is, it is not despun for steering. For example, in one embodiment, the nose assembly 106 revolves between about 2 revolutions per second to 30 revolutions per second. Of course, a broad range of revolution rates will also be applicable and will be readily determined by one of ordinary skill in the art. In one embodiment, the rate of spin of the nose assembly 106 is much less than 300 revolutions per second or hertz (Hz).

Accordingly, braking devices for despinning are not needed, nor are sensors for needed for determining a rotational orientation of a despun portion relative to a spinning portion. It should be noted that it is the operation of the spin fins 113 that causes the nose assembly 106 to spin. Additionally, rifling of the barrel may result in the nose assembly spinning in the opposite angular direction than intended initially upon launch. After a short period of time, the torque from the spin fins 113 from flight results in continuous spinning of the nose assembly 106. Additionally, power from the spinning of the nose assembly 106 relative to the projectile 100 can be tapped to generate electrical power by the generator or alternator. In one embodiment, the power control electronics waits until the nose assembly 106 is spinning before activating the generator or alternator. The wait can be determined by a period of time, by monitoring rotating speed (RPM), by a combination of the two, or the like.

Figure 4:
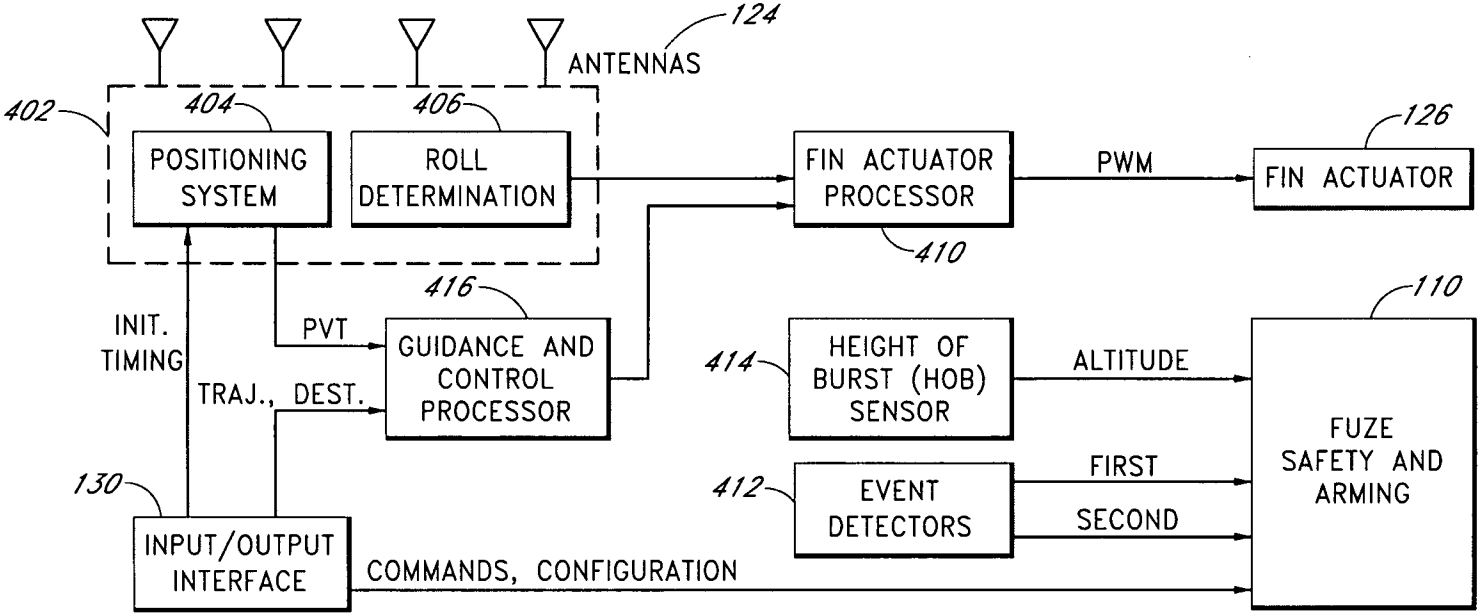
FIG. 4 illustrates an example of a functional block diagram.

FIG. 4 illustrates an example of a functional block diagram. The various blocks are typically implemented by a combination of hardware and software/firmware stored in a computer-readable memory and executed by a processor.

A dashed block 402 includes RF components such as a positioning system 404, such as GPS, and a roll determination block 406, which can determine both spatial position and rotational position based on signals received from one or more antennas 124. For example, position, velocity, and time can be provided from the positioning system 404 as an input to a guidance and control processor 416. The roll determination block 406 can provide an indication of an angle to a fin actuator processor 410, which can be part of a guidance and control processor 416. Prior to launch of the projectile 100 (FIG. 1), an input/output interface 130, such as inductive pickup/interface for EPIAFS, can be used to initialize the positioning system with timing signals, ephemeris data, and the initial location of the corresponding receiver for fast acquisition to satellite signals, such as the spread spectrum signals of GPS satellites. The input/output interface 130 can provide trajectory data and destination dated to the guidance and control processor 416. Further, the input/output interface 130 can provide commands and configuration information for the fuze 110.

Based on pre-programmed trajectory and destination data, obtained from the input/output interface 130 and actual trajectory data obtained from a positioning system 404, the guidance and control processor 416 provides steering commands to the fin actuator processor 410. The fin actuator processor 410 combines the steering information from the guidance and control processor 416 with the roll angle from the roll determination block to generate control signals for the fin actuator 126. In one embodiment, the fin actuator is the voice coil actuator and the control signals generated by the fin actuator processor 410 are pulse width modulated (PWM). Of course, power transistors may also be included in the signal path between the fin actuator processor 410 and the fin actuator 126.

A portion of the fuze system 110 will not be described. Event detectors 412 provide inputs to the fuze 110. For example, a first event can correspond to the sensing of a very high acceleration corresponding to launch of the projectile 100. A second event can correspond to the sensing of a minimum airspeed, which can be indicated by detection of a rotational rate of the nose assembly 106. When both the first event and the second event are detected, the safeties for the fuze 110 can be disabled. In the illustrated embodiment, the fuse is activated when a height of burst sensor 414 determines that the projectile is a particular height above ground.

Various embodiments have been described above. Although described with reference to these specific embodiments, the descriptions are intended to be illustrative and are not intended to be limiting. Various modifications and applications may occur to those skilled in the art.

What is claimed is:

1. An apparatus comprising:

a threaded housing configured to fasten into a fuze well of a projectile for attachment;

a nose assembly configured to mate with the threaded housing such that at least a first portion of the nose assembly is within an interior of the threaded housing and a second portion of the nose assembly is outside of the threaded housing, wherein the nose assembly is configured to revolve without despinning with respect to the threaded housing;

one or more fixed spin fins coupled to the nose assembly, wherein the one or more fixed spin fins are configured to generate a torque during flight in angular direction opposite to an angular direction of a spin of the projectile;

one or more antennas configured to receive Global Positioning System (GPS) satellite navigation signals, wherein the one or more antennas are attached to the nose assembly such that the one or more antennas revolve with the nose assembly and not with the projectile;

a GPS receiver configured to determine spatial position and rotational position, wherein the GPS receiver is coupled to the one or more antennas;

a voice coil actuator;

movable fins coupled to the nose assembly, wherein the movable fins are configured to move based on actuation by the voice coil actuator for steering of the projectile;

a guidance and control system configured to control the voice coil actuator based at least partly on a pre-programmed trajectory, spatial position, and rotational position;

a fuze for triggering of the artillery round, wherein the fuze is disposed within the first portion of the nose assembly;

an alternator configured generate electrical power during flight of the artillery round and is not configured to controllably brake the nose assembly relative to the threaded housing, wherein at least a portion of the alternator is disposed in the threaded housing and another portion is disposed in the nose assembly; and at least one of a battery or a capacitor configured to provide power prior to operation of the alternator.

2. The apparatus of claim 1, wherein a rate of revolution for the nose assembly during flight after initial spin up is between about 2 hertz to 30 hertz.

3. The apparatus of claim 1, further comprising a fuze disposed in the nose assembly for triggering of an explosive of the projectile.

4. The apparatus of claim 1, further comprising a configurable arming mechanism for the fuze.

5. An apparatus comprising:

a housing configured to mount in a fuze well of a projectile for attachment;

a nose assembly configured to mate with the housing such that at least a first portion of the nose assembly is within an interior of the housing and a second portion of the nose assembly is outside of the housing;

one or more spin fins coupled to the nose assembly, wherein the one or more spin fins are configured to generate a torque during flight in an opposing direction to a direction of spin, if any, of the projectile, wherein the nose assembly is configured to revolve even during flight control;

an actuator;

one or more control surfaces coupled to the nose assembly, wherein the one or more control surfaces are configured to steer the projectile based on actuation by the actuator; and a guidance and control system configured to control the actuator based at least partly on a pre-programmed trajectory, spatial position, and rotational position.

6. The apparatus of claim 5, wherein the actuator comprises a voice coil actuator.

7. The apparatus of claim 6, wherein actuation of the voice coil actuator varies at least partly based on an angle of the nose assembly relative to a reference angle external to the projectile.

8. The apparatus of claim 5, wherein the nose assembly revolves during flight at a spin rate less than 30 Hz.

9. The apparatus of claim 5, wherein the one or more control surfaces are deflected in a first direction relative to the nose assembly when the nose assembly is at a first rotational position external to the projectile, and are deflected in a second direction opposite to the first direction when the nose assembly is at a second rotational position 180 degrees opposite to the first rotational position.

10. The apparatus of claim 5, further comprising a height of burst sensor for triggering of the fuze.

11. The apparatus of claim 5, further comprising:

one or more antennas configured to receive satellite positioning system signals, wherein the one or more antennas are attached to the nose assembly such that the one or more antennas revolve with the nose assembly and not with the projectile; and a satellite positioning system receiver configured to determine spatial position and rotational position, wherein the satellite positioning system receiver is coupled to the one or more antennas, wherein the satellite positioning system receiver is configured to determine spatial position.

12. A method of controlling flight of a projectile, the method comprising:

spinning a nose assembly via torque generated by one or more spin fins coupled to the nose assembly, wherein after launch and initial spin up, the nose assembly is spun continuously during flight, wherein the nose assembly comprises the one or more spin fins, a satellite positioning system receiver, one or more antennas for the satellite positioning system receiver, one or more control surfaces, and an actuator for the one or more control surfaces;

actuating the one or more control surfaces to steer the projectile, wherein actuating is performed while the nose assembly is revolving without despinning the nose assembly to control the flight of the projectile; and steering the projectile along a pre-programmed trajectory.

13. The method of claim 12, wherein the actuator comprises a voice coil actuator.

14. The method of claim 13, further comprising actuating the voice coil actuator at least partly based on an angle of the nose assembly relative to a reference angle external to the projectile.

15. The method of claim 12, further comprising:

deflecting the one or more control surfaces in a first direction relative to the nose assembly when the nose assembly is at a first rotational position external to the projectile; and deflecting the one or more control surfaces in a second direction opposite to the first direction when the nose assembly is at a second rotational position 180 degrees opposite to the first rotational position for steering of the projectile.

16. An apparatus for controlling flight of a projectile, the apparatus comprising:

means for spinning a nose assembly via torque generated by one or more spin fins coupled to the nose assembly, wherein after launch and initial spin up, the nose assembly is spun continuously during flight, wherein the nose assembly comprises the one or more spin fins, a satellite positioning system receiver, one or more antennas for the satellite positioning system receiver, one or more control surfaces, and an actuator for the one or more control surfaces;

means for actuating the one or more control surfaces to steer the projectile, wherein actuating is performed while the nose assembly is revolving without despinning the nose assembly to control the flight of the projectile; and means for steering the projectile along a pre-programmed trajectory.

* * * * *